United States Patent [19]

Bouchard et al.

[11] Patent Number: 4,978,180

[45] Date of Patent: Dec. 18, 1990

[54] TRI-MODEL TYPE CIRCUIT BREAKER AND RAPID-START FLUORESCENT LAMP CONTAINING SAME

[75] Inventors: Andre C. Bouchard, Peabody; Carlo S. Bessone, Bedford, both of Mass.

[73] Assignee: GTE Products Corporation, Danvers, Mass.

[21] Appl. No.: 406,206

[22] Filed: Sep. 11, 1989

[51] Int. Cl.[5] ..... H01J 7/44; H05B 41/18

[52] U.S. Cl. ..... 315/73; 337/27; 445/20

[58] Field of Search ..... 315/73; 337/27; 445/20

[56] References Cited

U.S. PATENT DOCUMENTS

| | | | |
|---|---|---|---|
| 2,536,280 | 1/1951 | Haegele | 337/27 |
| 4,510,418 | 4/1985 | Anderson, Jr. et al. | 315/73 |
| 4,517,493 | 5/1985 | Dembowski et al. . | |
| 4,528,479 | 7/1985 | Bonazoli et al. | 315/73 |
| 4,572,986 | 2/1986 | Sindlinger | 315/73 |
| 4,600,861 | 7/1986 | Sindlinger . | |
| 4,616,156 | 10/1986 | Roche et al. . | |
| 4,656,396 | 4/1987 | Audesse | 315/73 |
| 4,659,966 | 4/1987 | Roche . | |
| 4,709,187 | 11/1987 | Roche | 315/73 |
| 4,754,198 | 6/1988 | Brower | 315/73 |

*Primary Examiner*—Eugene R. LaRoche
*Assistant Examiner*—Son Dinh
*Attorney, Agent, or Firm*—Carlo S. Bessone

[57] ABSTRACT

A tri-model circuit breaker for use in a rapid-start fluorescent lamp. The circuit breaker includes a glass bulb, first and second electrical leads sealed into and passing through the glass bulb, and a bimetallic element disposed within the bulb and having first and second end portions. The first end portion of the bimetallic element is affixed to the first electrical lead while the second end portion of the bimetallic element is formed to be spaced from the second electrical lead at a first elevated temperature and in contact with the second electrical lead at ambient temperature and at a second elevated temperature higher than the first elevated temperature. The contact points of the circuit breaker at ambient and at the second elevated temperature are at the same location within the breaker.

9 Claims, 2 Drawing Sheets

TRI-MODEL TYPE CIRCUIT BREAKER AND RAPID-START FLUORESCENT LAMP CONTAINING SAME

FIELD OF THE INVENTION

This invention relates in general to bimetal type circuit breakers suitable for use with fluorescent lamps and more particularly to tri-model or triple-acting bimetal circuit breakers suitable for enclosure within a rapid-start fluorescent lamp.

BACKGROUND OF THE INVENTION

Generally, the two common forms of fluorescent lamps are the so-called "preheat" type or the "rapid-start" type. The preheat type of fluorescent lamp has heater current flow through each electrode during lamp ignition and thereafter a voltage-sensitive starter, located external to the lamp or within the lamp itself, opens and discontinues the above-mentioned heater current flow. However, the "rapid-start" type of fluorescent lamp normally has current flow through each electrode not only during ignition but also during the operational period of the lamp. Thus, it can readily be seen that this continuous flow of heater current during operation of the rapid-start lamp is a cause for power loss in the system and an obvious and undesired cause for reduced operational efficiency.

In an effort to improve the energy efficiency of rapid-start fluorescent lamps, numerous suggestions and structural configurations have been suggested. For example, U.S. Pat. Nos. 4,052,687; 4,097,779; 4,114,968; 4,156,831; and 4,171,519 all of which are assigned to the assignee of the present application, provide numerous configurations for enhancing the operation of rapid-start fluorescent lamps. Primarily, each of the above-listed patents relates to rapid-start fluorescent lamps or bimetal type circuit breakers for fluorescent lamps whereby heater current flow is discontinued during lamp operation.

Although the configurations and techniques disclosed by the above-listed patents enhance and provide numerous advantages over prior known configurations and techniques, it has been found that problems still remain. The electrodes of the fluorescent lamp include a carbonate material which requires activation during lamp manufacture by passing current through the electrodes. During this manufacturing step, the circuit breaker is subjected to temperatures sufficiently high (about 300 degrees Celsius) which otherwise maintain the circuit breaker open. Therefore, it has been found necessary to provide a means for essentially removing the circuit breaker effect from the mount structure until after the carbonate material of the electrode has been activated.

In order to accomplish the activation of the carbonate material, an electrical shunt material is coupled across the leads of the circuit breaker to permit current flow to the electrodes. However, once the carbonate material on the electrodes has been processed, it is necessary to remove the electrical shunt material by applying an electrical pulse through each of the shunts. Although such structures have been and still are employed with relatively good results, it has been found that a circuit breaker wherein such electrical shunts are required does present problems of extra materials, added labor, increased defects and reduced productivity all of which increases cost and reduces manufacturing efficiency. Moreover, lamp processing introduces numerous oxidation problems associated with correct attaching of the shunt material.

U.S. Pat. No. 4,517,493 is an example of a fluorescent lamp having a circuit breaker which does not require the above-described electrical shunt across the circuit breaker. This patent teaches a third lead-in wire (19) in each mount which bypasses the circuit breaker and allows the cathodes to be activated. After each lamp cathode has been activated, the third lead-in wire is not further used. An additional step is required to clip off or bend out of the way the end portion of this lead-in wire presumably so as not to interfere with the remaining lead-in wires (16, 17).

Other attempts have been made to provide a circuit breaker which does not require the above-described electrical shunt or a third lead-in wire. For example, U.S. Pat. Nos. 4,600,861, 4,616,156 and 4,659,966 all of which are assigned to the assignee of the present application, describe tri-model circuit breakers. While these circuit breakers may provide relatively good results, they may require some precision in forming since each closed position requires the bimetal to engage two separate contact points within the circuit breaker. The two separate contact points may undesirably exhibit different contact resistances.

SUMMARY OF THE INVENTION

An object of the present invention is to provide an enhanced bimetal type circuit breaker. Another object of the invention is to provide an improved rapid-start fluorescent lamp. Still another object of the invention is to provide an enhanced rapid-start fluorescent lamp having increased efficiency. A further object of the invention is to provide a bimetal type circuit breaker which is simple and inexpensive to manufacture and requires neither the presence or removal of a shunting material short-circuiting the circuit breaker electrical conductors. A still further object is to provide a tri-model circuit breaker which does not require the bimetal to engage two different contact points. A further object of the invention is to provide an improved fluorescent lamp which does not require a third lead-in wire.

These objects are accomplished in one aspect of the invention by the provision of a tri-model circuit breaker which includes a glass bulb, first and second electrical leads sealed into and passing through the glass bulb, and a bimetallic element disposed within the bulb and having first and second end portions. The first end portion of the bimetallic element is affixed to the first electrical lead. The second end portion of the bimetallic element is formed to be spaced from the second electrical lead at a first elevated temperature and in contact with the second electrical lead at ambient temperature and at a second elevated temperature higher than the first elevated temperature. The thermal switch has contact points at ambient and the second elevated temperature at the same location within the switch.

In accordance with further teachings of the present invention, the first elevated temperature higher than ambient temperature is about 100 degrees Celsius. Preferably, the second elevated temperature higher than the first elevated temperature is about 300 degrees Celsius and ambient temperature is 25 degrees Celsius.

The objects are accomplished in another aspect of the invention by the provision of a rapid-start fluorescent lamp including a light-transmitting envelope containing an ionizable medium. A phosphor coating is disposed on the inner surface of the envelope. A pair of spaced electrodes are positioned within the ends of the envelope. A pair of electrical leads is sealed into each end of the envelope and is formed for connection to an external energizing source with one of the electrical leads directly connected to an electrode. A circuit breaker is disposed within each end of the envelope with the circuit breaker coupling the other one of the pair of electrical leads to the electrode. The circuit breaker includes a glass bulb, first and second electrical conductors sealed into and passing through the bulb, and a bimetallic element disposed within the bulb and having first and second end portions. The first end portion of the bimetallic element is affixed to the first electrical lead. The second end portion of the bimetallic element is formed to be spaced from the second electrical lead at a first elevated temperature and in contact with the second electrical lead at ambient temperature and at a second elevated temperature higher than the first elevated temperature. The thermal switch has contact points at ambient and the second elevated temperature at the same location within the switch.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
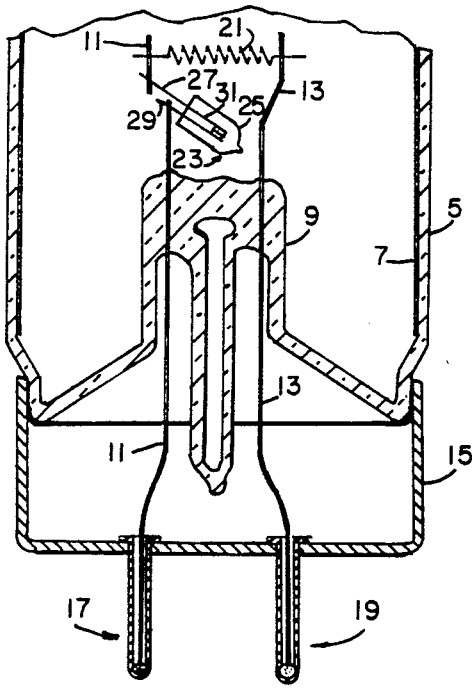
FIG. 1 is a front elevated view, partially in section, of one end of a rapid-start fluorescent lamp employing the tri-model circuit breaker according to the teaching of the present invention.

Referring to FIG. 1 of the drawings, a rapid-start fluorescent lamp includes an elongated glass envelope 5 having a coating of phosphors 7 on the inner wall surface. Each end of the fluorescent lamp includes a glass stem member 9 sealed into the end of the envelope 5 and a pair of electrical leads 11 and 13 sealed therein and passing therethrough. An end cap or base 15 is telescoped over and attached to the end of the glass envelope 5 and includes a pair of pins 17 and 19 electrically connected respectively to a portion of the electrical leads 11 and 13 and formed to provide electrical connection to an external source (not shown). Moreover, the envelope 5 has a gas fill therein selected from the group consisting of argon, krypton, neon, helium and combinations thereof at a pressure from about 1.0 to 4.0 torr.

An electrode 21 is located within each end of envelope 5 and connected at opposite ends to the upper portion of electrical lead 11 and 13. Electrode 21, which is frequently referred to as a filament or cathode, is of a well-known type used in rapid-start fluorescent lamps and usually includes a tungsten coil having an emissive material thereon in the form of alkaline earth oxides which were applied in the form of carbonates and processed to provide the oxides.

In accordance with the teachings of the present invention, a tri-model circuit breaker 23 is disposed within each end of envelope 5 and couples electrical lead 11 to electrode 21. With particular attention to FIG. 2, circuit breaker 23 includes a thermally-sensitive bimetallic element 31 disposed within a glass bulb or bottle 25 having a press seal at one end thereof. A pair of electrical conductors 27 and 29 are sealed into and pass through the press seal of glass bulb 25. One end of electrical conductor 29 may include a conductive contact pad 37 (i.e., silver) affixed thereto. Bimetallic element 31 includes a first end portion 33 and a second end portion 35. First end portion 33 of bimetallic element 31 is affixed (e.g., by welding) to electrical conductor 27. The opposite end 35 of bimetallic element 31 is formed to electrically contact electrical conductor 29 and may also include a conductive contact pad 39 affixed thereto. Electrical conductors 27 and 29 extend outwardly of the glass bulb 25 and as illustrated in FIG. 1 are connected respectively to one end of the electrode 21 via the upper portion of electrical lead 11 and to base pin 17 via the lower portion of electrical lead 11.

Figure 2:
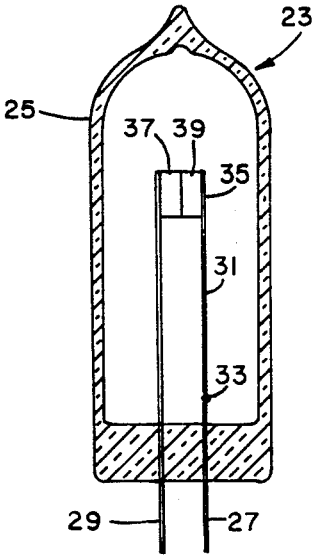
FIG. 2 is a cross-sectional view of an embodiment of a tri-model circuit breaker illustrating the location of the contacts at ambient temperature and at a second elevated temperature.

As can more readily be seen in the operational configuration of FIG. 2, thermally-sensitive bimetallic element 31 is formed such that second end portion 35, which includes conductive contact pad 39 electrically contacts conductive contact pad 37 of second electrical conductor 29 at ambient temperature, such as a temperature of about 25 degrees Celsius (Condition A). In this condition, heater current is allowed to flow through electrode 21 to permit starting.

Figure 3:
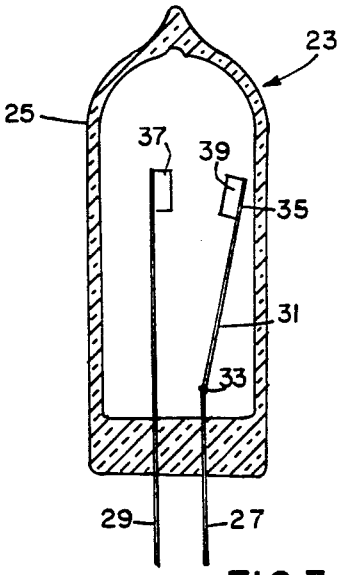
FIG. 3 is a cross-section view of the tri-model circuit breaker of FIG. 2 illustrating the location of the contacts at a temperature between ambient and the second elevated temperature (i.e., at a first elevated temperature)

During the operational period of the lamp, bimetallic element 31 attains a temperature of about 100 degrees Celsius and is caused to deflect away from second electrical conductor 29 as illustrated in FIG. 3 (Condition B). As a result, heater current to electrode 21 is discontinued and the energy efficiency of the lamp is increased.

During the lamp manufacturing process as the temperature of the bimetallic element gradually increases, thermally-sensitive bimetallic element 31 is momentarily deflected away from second electrical conductor 29 at a temperature of about 100 degrees Celsius but returns to a closed position as illustrated in FIG. 2 (Condition C) as the temperature reaches about 300 degrees Celsius. Bimetallic element 31 electrically contacts second electrical conductor 29 thus permitting current flow through electrical conductor 11 (FIG. 1), circuit breaker 23, electrode 21 and electrical conductor 13 for activation of the carbonate material on electrode 21.

Figure 4:
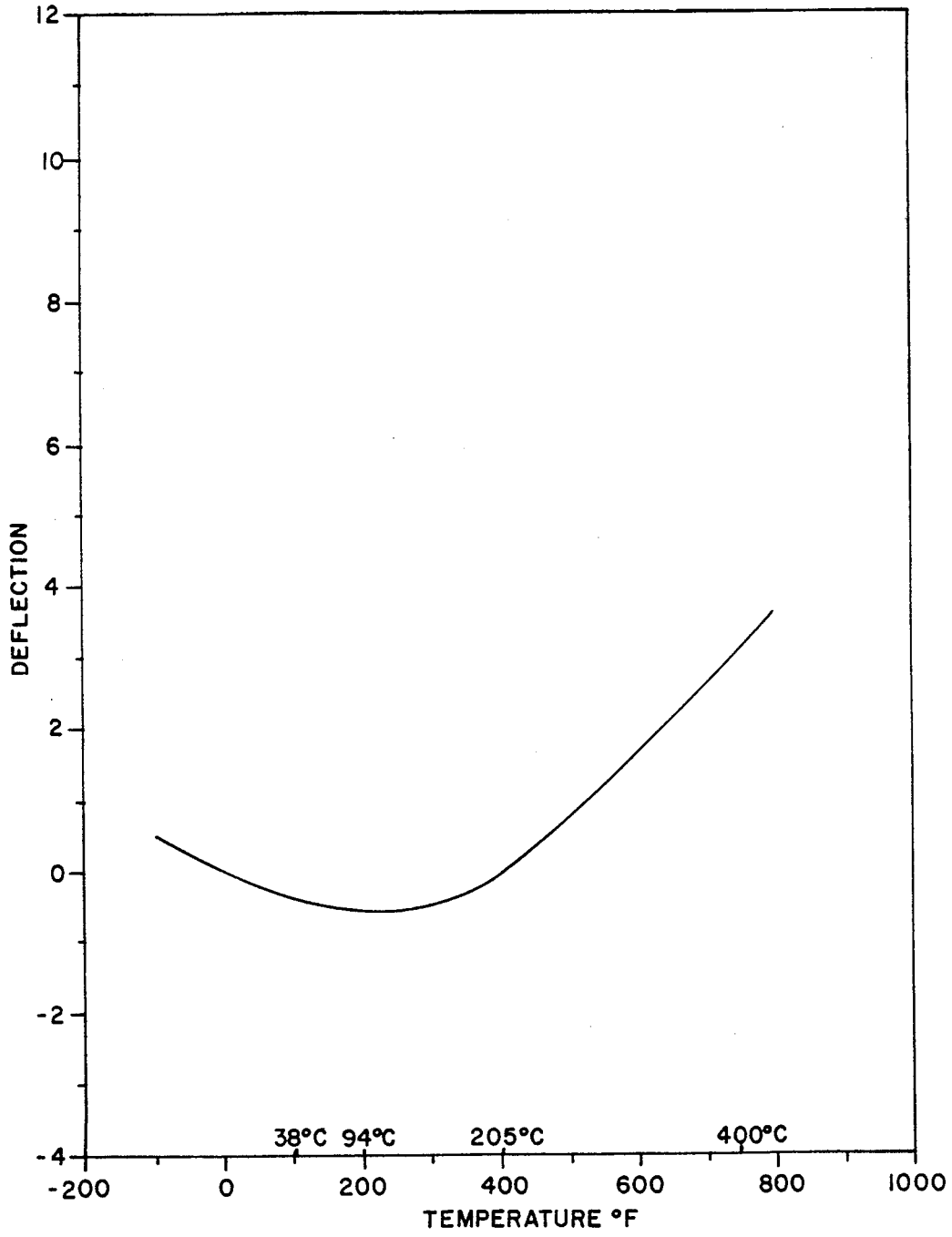
FIG. 4 is a graph depicting the deflection characteristics of a preferred material for use as the bimetallic element of the tri-model circuit breaker of the present invention.

One suitable material for the bimetallic element is type 4600 available from Advanced Metallurgy Inc., Reidsville, N.C. 27320. The deflection characteristics of type 4600 is depicted in FIG. 4. As show therein, the bimetallic element deflects in one direction at temperatures up to about 100 degrees Celsius and deflects in an opposite direction at temperatures greater than 100 degrees Celsius.

In one embodiment, a 0.010 inch thick bimetal blade was used. The blade is 0.060 inch wide and 0.750 inch long. The free end of the bimetallic blade at 25 degrees Celsius is formed so as to be in contact with the opposing lead of the circuit breaker.

Accordingly, a tri-model circuit breaker for use in a rapid-start fluorescent lamp has been provided wherein three operational modes are attainable. In a first mode (Condition A), the bimetallic element is at an ambient temperature and provides electrical contact between first and second electrical conductors. In a second mode (Condition B), the bimetallic element is at a higher temperature (i.e., at a fluorescent lamp operational temperature) and there is no contact between the first and second electrical conductors and no heater current flows to the electrode. Finally, in a third operational mode (Condition C), the first and second electrical conductors are again in contact at an even higher temperature whereby activation of the potentially electron emissive material of the cathode may be affected.

There has thus been shown and described a tri-model circuit breaker and rapid-start fluorescent lamp containing the circuit breaker. It may be noted that the above-described circuit breaker configuration and rapid-start fluorescent lamps utilizing such circuit breaker configurations are not only more easily manufactured than circuit breakers and lamps wherein shunting of the bimetal strip was necessary but are also more economical of components and assembly time. Moreover, testing of the circuit breaker is enhanced with the above-described improved structure since the shunting mechanism resistance does not interfere with the measurement of the capsule contact resistance. Also, the fluorescent lamps do not require the use of a third lead-in wire to affect cathode activation.

While there have been shown and described what are at present considered to be the preferred embodiments of the invention, it will be apparent to those skilled in the art that various changes and modifications can be made herein without departing from the scope of the invention. For example, the rapid-start fluorescent lamp of the present invention may also incorporate a tri-model thermal switch shunting the cathode as taught in U.S. Serial No. (Attorney docket no. D-89-1-426) and assigned to the Assignee of this application. As taught therein, the thermal switch produces a double hot spot on the shunted cathode during lamp operation.

Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A tri-model circuit breaker for use in a rapid-start fluorescent lamp comprising:

a glass bulb;

first and second electrical conductors sealed into and passing through said bulb; and a bimetallic element disposed within said bulb and having first and second end portions, said first end portion of said bimetallic element being affixed to said first electrical lead, said second end portion of said bimetallic element being formed to be spaced from said second electrical lead at a first elevated temperature and in contact with said second electrical lead at ambient temperature and at a second elevated temperature higher than said first elevated temperature, said thermal switch having contact points at ambient and said second elevated temperature at the same location within said switch.

2. The tri-model circuit breaker of claim 1 wherein said first elevated temperature is about 100 degrees Celsius.

3. The tri-model circuit breaker of claim 1 wherein said second elevated temperature is about 300 degrees Celsius.

4. The tri-model circuit breaker of claim 1 wherein said ambient temperature is a temperature of about 25 degrees Celsius.

5. The circuit breaker of claim 1 wherein said envelope is a hermetically sealed glass envelope.

6. A rapid-start fluorescent lamp comprising:

a glass envelope having a phosphor-coated inner wall surface;

a pair of spaced electrodes positioned within the ends of said envelope;

a pair of electrical leads sealed into each end of said envelope and formed for connection to an external energizing source with one of said electrical leads directly connected to an electrode and;

a circuit breaker disposed within each end of said envelope with said circuit breaker coupling the other one of said pair of electrical leads to said electrode, said circuit breaker including a glass bulb, first and second electrical conductors sealed into and passing through said bulb, and a bimetallic element disposed within said bulb and having first and second end portions, said first end portion of said bimetallic element being affixed to said first electrical lead, said second end portion of said bimetallic element being formed to be spaced from said second electrical lead at a first elevated temperature and in contact with said second electrical lead at ambient temperature and at a second elevated temperature higher than said first elevated temperature, said thermal switch having contact points at ambient and said second elevated temperature at the same location within said switch.

7. The tri-model circuit breaker of claim 6 wherein said first elevated temperature is about 100 degrees Celsius.

8. The tri-model circuit breaker of claim 6 wherein said second elevated temperature is about 300 degrees Celsius.

9. The tri-model circuit breaker of claim 6 wherein said ambient temperature is a temperature of about 25 degrees Celsius.

* * * * *